US008816931B2

(12) United States Patent
Chou

(10) Patent No.: US 8,816,931 B2
(45) Date of Patent: Aug. 26, 2014

(54) METHOD OF LOOP ANTENNA AND IMPROVED LOOP ANTENNA THEREOF

(75) Inventor: Chen-Yu Chou, New Taipei (TW)

(73) Assignee: Wistron Corporation, New Taipei (TW)

( * ) Notice: Subject to any disclaimer, the term of this patent is extended or adjusted under 35 U.S.C. 154(b) by 235 days.

(21) Appl. No.: 13/470,357

(22) Filed: May 14, 2012

(65) Prior Publication Data

US 2013/0207873 A1 Aug. 15, 2013

(30) Foreign Application Priority Data

Feb. 9, 2012 (TW) ..... 101104255 A

(51) Int. Cl.
*H01Q 7/00* (2006.01)

(52) U.S. Cl.
CPC ..... *H01Q 7/00* (2013.01)
USPC ..... 343/866; 343/741

(58) Field of Classification Search
CPC ..... H01Q 7/00; H01Q 1/36; H01Q 9/04
USPC ..... 343/866, 741
See application file for complete search history.

(56) References Cited

U.S. PATENT DOCUMENTS

| | | | | |
|---|---|---|---|---|
| 6,518,937 | B2 * | 2/2003 | Fang | 343/895 |
| 6,756,946 | B1 * | 6/2004 | Deng et al. | 343/742 |
| 7,512,413 | B2 | 3/2009 | Hui et al. | |
| 8,179,329 | B2 * | 5/2012 | Kato | 343/726 |

* cited by examiner

*Primary Examiner* — Hoang V Nguyen
(74) *Attorney, Agent, or Firm* — Jianq Chyun IP Office

(57) ABSTRACT

An improved method of loop antenna and improved loop antenna thereof are provided, the method is used to generate an antenna resonant frequency for a conformed specific communication by modifying a resonant wavelength of a basic loop antenna. The improved method of loop antenna includes the following steps: connecting a first antenna radiator to a resonant point of the basic loop antenna electrically, and using an additional length from the connected first antenna radiator additional length to increase the resonant wavelength of the basic loop antenna, in order to generate an antenna resonant frequency conformed to the specific communication system.

10 Claims, 2 Drawing Sheets

METHOD OF LOOP ANTENNA AND IMPROVED LOOP ANTENNA THEREOF

CROSS-REFERENCE TO RELATED APPLICATION

This application claims the priority benefit of Taiwan application serial no. 101104255, filed on Feb. 9, 2012. The entirety of the above-mentioned patent application is hereby incorporated by reference herein and made a part of this specification.

BACKGROUND OF THE INVENTION

1. Field of the Invention

The invention is an improved method of loop antenna and the improved loop antenna thereof, and more particularly, to apply on the global positioning system.

2. Description of Related Art

While the functional requirements for smart phones are increasing, unfortunately with the current existing technology, the lack of space on the hardware frameworks is the most difficult challenge to overcome in the industry. The antenna structure for the Global Positioning System (GPS) requires a certain amount of configuration space, however, due to the volume of the smart phone design reduces as the antenna technology progresses, the configuration space would be compressed. Therefore, under the circumstance of limited space, the design for the GPS antenna structure would face the great challenge.

In general, if the configuration space is enough, the design for Patch Antenna would be the first choice. However, under the circumstance of limited space, the design for Solid Metal Structuring antenna or Laser Direct Structuring (LDS) antenna can be applied with various ways of structural design instead, even though in terms of costs will be more expensive. If the budget is relatively low, the design for Chip antenna can be chosen, but the drawbacks will be the poor efficiency and the requirement of larger space, as a result, such design is less likely to be applied on the small-size and portability of smart phones.

SUMMARY OF THE INVENTION

One aspect of the invention provides an improved method of loop antenna, by modifying a resonant wavelength of a basic loop antenna, in order for an antenna resonant frequency of a conformed specific communication system to be generated, the improved method of the loop antenna includes the following steps: connecting a first antenna radiator to a resonant point of the basic loop antenna electrically, and using an additional length the basic loop antenna from the connected first antenna radiator additional length to increase the resonant wavelength of the basic loop antenna, in order to generate the resonant frequency that conformed to the specific communication system.

Another aspect of the invention provides an improved loop antenna, comprising a basic loop antenna and a first antenna radiator. By modifying the antenna resonant wavelength of the basic loop antenna, an antenna resonant frequency that conformed to a specific communication system is generated. The first antenna radiator is connected to a resonant point of the basic loop antenna electrically. The first antenna radiator is used to increase the resonant wavelength of the basic loop antenna, in order to generate the resonant frequency of the conformed specific communication system.

In order to make the features and advantages of the invention more comprehensible, the invention is further described in detail in the following with reference to the embodiments and the accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
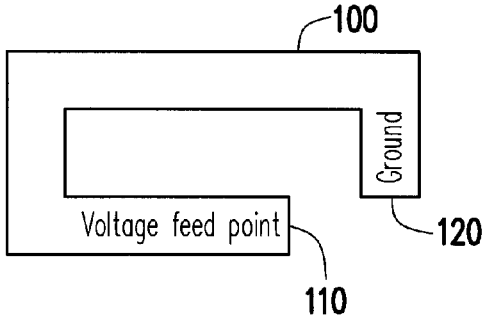
FIG. 1 is a schematic diagram illustrating a conventional type of the basic loop antenna.

Reference will now be made in detail to the present embodiments of the invention, examples of which are illustrated in the accompanying drawings. Wherever possible, the same reference numbers are used in the drawings and the description to refer to the same or like parts.

FIG. 1 is a schematic diagram illustrating a conventional type of the basic loop antenna. A basic loop antenna 100 has a voltage feed point 110 and a ground 120. For example, the antenna resonant frequency of the loop antenna of the global positioning system is between 1.57 and 2.4 GHz. In general, the conventional structure of the basic loop antenna 100 in FIG. 1, allows a resonant frequency to reach one of the high values among the range of 1.57 to 2.4 GHz. However, if users want to get a less value of the antenna resonant frequency by modifying the resonant wavelength of the basic loop antenna 100, then the structure of the basic loop antenna 100 will be required to modify.

Figure 2:
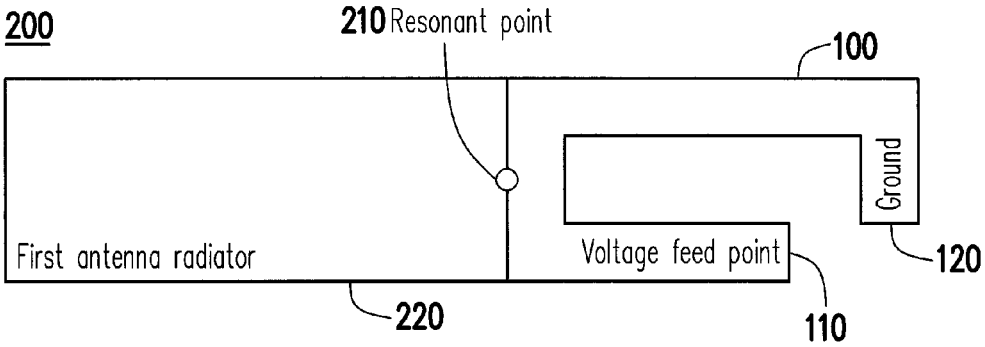
FIG. 2 is a schematic diagram illustrating an improved design of loop antenna in accordance with an embodiment of the invention.
Figure 3:
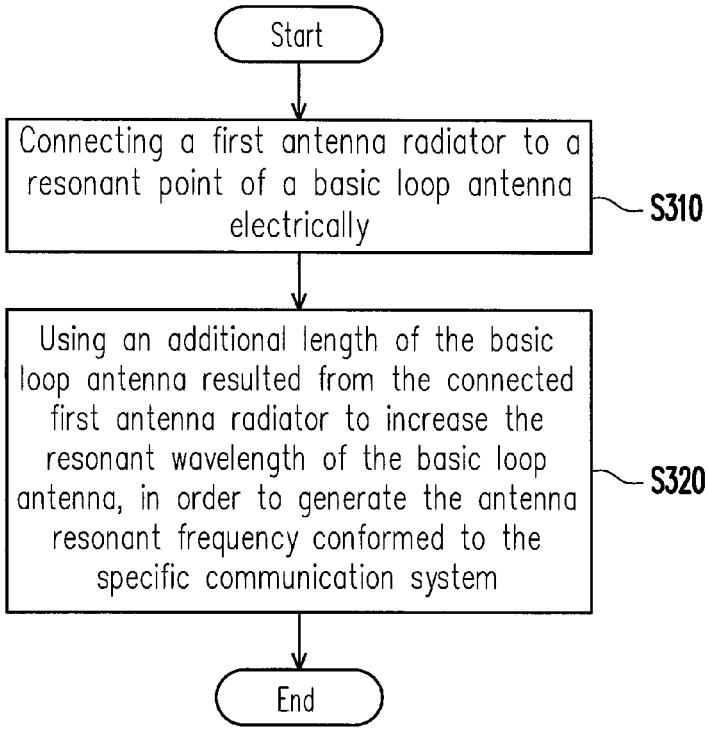
FIG. 3 is a flow chart diagram illustrating an improved method of loop antenna in accordance with an embodiment of the invention.

FIG. 2 is a schematic diagram illustrating an improved design of loop antenna, in accordance with an embodiment of the invention. FIG. 3 is a flow chart diagram illustrating an improved method of loop antenna in accordance with an embodiment of the invention. Please refer to FIG. 2 and FIG. 3. An improved loop antenna 200 illustrated in FIG. 2 and an improved method of loop antenna illustrated in FIG. 3, generate an antenna resonant frequency of a conformed specific communication system by modifying the resonant wavelength of the basic loop antenna 100. First of all, a first antenna radiator 220 is used to connect to a resonant point 210 of the basic loop antenna electrically (Step S310). Next, the first antenna radiator 220 is used for an additional length of the basic loop antenna 100, is to increase the resonant wavelength of the basic loop antenna 100, in order to generate the antenna resonant frequency conformed to the specific communication system. (Step 320).

In other words, the improved loop antenna 200 that is the resonant point 210 of the basic loop antenna 100 is connected to the first antenna radiator 220 electrically so as to the length of the overall antenna structure to be extended. As for the additional length over the basic loop antenna 100, the first antenna radiator 220 is then used to increase the resonant wavelength of the basic loop antenna 100. This also implies that the structure of the improved loop antenna 200 enables the resonant wavelength to extend. From a physical point of view, when the resonant wavelength is extended, the antenna resonant frequency is decreased correspondingly. In the specific communication system of the embodiment, the range of the antenna resonant frequency for the GPS is between 1.57 and 2.4 GHz. FIG. 2 illustrates the structure of the improved loop antenna 200, which enables the antenna resonant frequency to decrease. This also implies that when users request to use a lower antenna resonant frequency, the structure of the improved loop antenna 200 illustrating in FIG. 2 can be applied.

Figure 4:
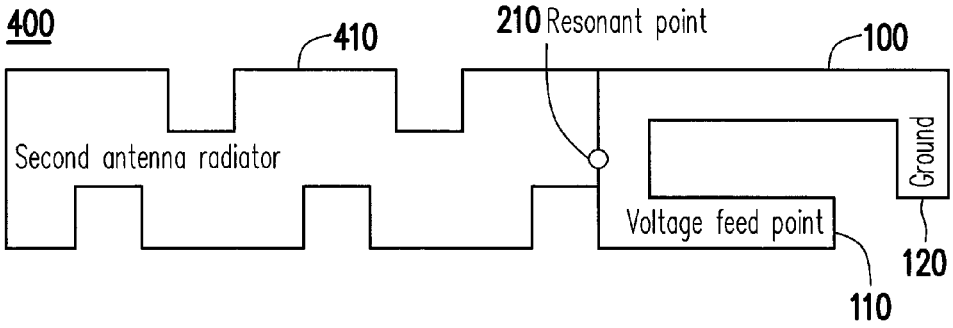
FIG. 4 is a schematic diagram illustrating an improved design of loop antenna in accordance with another embodiment of the invention.

FIG. 4 is a schematic diagram illustrating an improved design of loop antenna, in accordance with another embodiment of the invention. Except for including the basic loop antenna 100 as well as FIG. 3, the improved loop antenna 400 further comprises the use of a cavity structure on the first antenna radiator 220 to transform the first antenna radiator to form a second antenna radiator 410. The design of the cavity structure of the embodiment in FIG. 2, which helps the resonant path of the second antenna radiator 410 to extend further. For the additional length over the basic loop antenna 100, the second antenna radiator 410 is used to increase the resonant wavelength of the basic loop antenna 100. On the other hand, the antenna resonant frequency can become less. In other words, when users request to use a lower antenna resonant frequency, the structure of the improved loop antenna 200 illustrating in FIG. 4 can be applied.

In the aforementioned embodiments of the invention, both the first antenna radiator 220 and the second antenna radiator 410 can be fabricated of antenna shrapnel, a metal sheet, a flexible printed circuit board or a printed circuit board.

In other embodiments of the invention, the specific communication system is not just limited to the global positioning system. The specific communication system can also either be a wireless fidelity (WiFi) system or a third-generation (3G) wireless communication system. The improved method of loop antenna that provided by the invention, can base on the selected antenna resonant frequency of the specific communication system, to add either the first antenna radiator 220 or the second antenna radiator 410 on the basic loop antenna 100, in order for the original basic loop antenna 100 to obtain a longer resonant wavelength, and to generate a relatively low antenna resonant frequency.

In conclusion, the invention provides an improved method of loop antenna and the improved loop antenna thereof. According to the selected antenna resonant frequency of the specific communication system, the first antenna radiator or the second antenna radiator with the design of cavity structure can be applied on the basic loop antenna, and for the additional length over the basic loop antenna, an antenna radiator is used to increase the resonant wavelength of the basic loop antenna, in order to generate an antenna resonant frequency of the conformed specific communication system. Furthermore, the structural design of the first antenna radiator or the second antenna radiator of the invention is simple so that will not be accounted for the excess volume nor the extra increase for the space structural cost when the first antenna radiator or the second antenna radiator is configured inside the mobile communication equipment.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An improved method of a loop antenna, to generate an antenna resonant frequency conformed to a specific communication system by modifying a resonant wavelength of a basic loop antenna, the method comprising:

connecting a first antenna radiator to the basic loop antenna electrically via a resonant point of the basic loop antenna to obtain an improved loop antenna; and using an additional length of the basic loop antenna resulted from the connected first antenna radiator additional length to increase the resonant wavelength of the basic loop antenna, in order to generate the antenna resonant frequency conformed to the specific communication system, wherein a voltage feed point and ground of the improved loop antenna are respectively a voltage feed point and ground of the basic loop antenna.

2. The improved method of the loop antenna defined in claim 1, further comprising:

using a cavity structure on the first antenna radiator to transform the first antenna radiator to form a second antenna radiator, wherein the cavity structure extends a resonant path of the second antenna radiator; and using an additional length of the basic loop antenna resulted from the connected second antenna radiator additional length to increase a resonant wavelength of the basic loop antenna.

3. The improved method of the loop antenna defined in claim 1, wherein the first antenna radiator comprises antenna shrapnel, a metal sheet, a flexible printed circuit board or a printed circuit board.

4. The improved method of the loop antenna defined in claim 2, wherein the second antenna radiator comprises antenna shrapnel, a metal sheet, a flexible printed circuit board or a printed circuit board.

5. The improved method of the loop antenna defined in claim 1, wherein the specific communication system comprises a global positioning system (GPS), a wireless fidelity (WiFi) system, or a third-generation (3G) wireless communication system.

6. An improved loop antenna, comprising:

a basic loop antenna is used to generate an antenna resonant frequency conformed to a specific communication system by modifying a resonant wavelength of a basic loop antenna; and a first antenna radiator, is connected to the basic loop antenna electrically via a resonant point of the basic loop antenna, and the first antenna radiator is used for an additional length of the basic loop antenna, to increase the resonant wavelength of the basic loop antenna, in order to generate the antenna resonant frequency conformed to the specific communication system, wherein a voltage feed point and ground of the improved loop antenna are respectively a voltage feed point and ground of the basic loop antenna.

7. The improved loop antenna defined in claim 6, further comprising:

a cavity structure is used on the first antenna radiator to transform the first antenna radiator to form a second antenna radiator, wherein the cavity structure extends a resonant path of the second antenna radiator, and the second antenna radiator is used for an additional length of the basic loop antenna to increase a resonant wavelength of the basic loop antenna.

8. The improved loop antenna defined in claim 7, wherein the second antenna radiator comprises antenna shrapnel, a metal sheet, a flexible printed circuit board or a printed circuit board.

9. The improved loop antenna defined in claim 6, wherein the first antenna radiator comprises antenna shrapnel, a metal sheet, a flexible printed circuit board or a printed circuit board.

10. The improved loop antenna defined in claim 6, wherein the specific communication system comprises a global positioning system (GPS), a wireless fidelity (WiFi) system, or a third-generation (3G) wireless communication system.

* * * * *